US006806853B2

(12) United States Patent
Park et al.

(10) Patent No.: US 6,806,853 B2
(45) Date of Patent: Oct. 19, 2004

(54) DRIVING CIRCUIT FOR ACTIVE MATRIX ORGANIC LIGHT EMITING DIODE

(75) Inventors: Joon-Kyu Park, Seoul (KR); Han-Sang Lee, Gyeonggi-Do (KR); Sung-Joon Bae, Gyeonggi-Do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 309 days.

(21) Appl. No.: 10/175,835

(22) Filed: Jun. 21, 2002

(65) Prior Publication Data

US 2002/0196214 A1 Dec. 26, 2002

(30) Foreign Application Priority Data

Jun. 22, 2001 (KR) ..... 2001-35809

(51) Int. Cl.[7] ..... G09G 3/32
(52) U.S. Cl. ..... 345/82; 345/95; 315/169.3
(58) Field of Search ..... 345/82, 83, 84, 345/95, 210, 211; 315/169.3, 169.2, 169.1; 313/504; 257/88; 428/209, 690

(56) References Cited

U.S. PATENT DOCUMENTS 6,392,617 B1 * 5/2002 Gleason ..... 345/82
6,710,548 B2 * 3/2004 Kimura ..... 315/169.3
2003/0076048 A1 * 4/2003 Rutherford ..... 315/169.3
2003/0151577 A1 * 8/2003 Morita ..... 345/89
2003/0151578 A1 * 8/2003 Morita ..... 345/89

* cited by examiner

*Primary Examiner*—Amare Mengistu
(74) *Attorney, Agent, or Firm*—McKenna Long & Aldridge LLP

(57) ABSTRACT

A driving circuit for an active matrix organic light emitting diode includes a gamma voltage generation unit for generating differentiated gamma reference voltages corresponding to red, green, and blue colors and a driving unit for outputting a video data signal of a frame, by receiving the respective gamma reference voltages corresponding to red, green and blue colors generated in the gamma voltage generation unit and the power voltages corresponding to red, green and blue colors from the power supply unit. The driving circuit for the active matrix organic LED generates the video signal applied to the pixel for displaying the respective RGB colors, using the power voltages and gamma reference voltages which are independent according to the respective RGB colors and accordingly the pixel can be driven exactly as described using organic substances having different RGB characteristics, thus to improve the quality of the image.

20 Claims, 7 Drawing Sheets

DRIVING CIRCUIT FOR ACTIVE MATRIX ORGANIC LIGHT EMITING DIODE

This application claims the benefit of Korean Patent Application No. 2001-35809, filed on Jun. 22, 2001, which is hereby incorporated by reference for all purposes as if fully set forth herein.

BACKGROUND OF THE INVENTION

1. Field of the Invention

The present invention relates to a driving circuit for an active matrix organic light emitting diode. Particularly, the present invention relates to a driving circuit for an active matrix organic light emitting diode capable of driving an organic light emitting diode (LED) by supplying unique power voltages to organic LEDs capable of emitting red, green and blue colors.

2. Discussion of the Related Art

LEDs are devices that emit light when electrons and holes recombine within P–N junctions of semiconductor diodes. In thermal equilibrium, electrons and holes do not recombine due to the presence of a band gap energy between energy levels of the electrons and the holes. However, when a forward bias voltage is applied to the P–N junction, electrons migrate from a P region to an N region and holes migrate from the N regions to the P region. Accordingly, the migrating electrons and holes recombine to thereby emit light.

LEDs are fabricated from group III–V, II–VI, or V—V semiconductor materials. The color of light emitted by the LEDs depends on the band gap energy of the P–N junction. The band gap energy may be controlled by the composition ratio of the aforementioned semiconductor materials.

Contrary to thin film transistor liquid crystal diodes (TFT-LCD), organic LED devices may be manufactured to emit red, green, and blue colors without the use of color filters. Instead, red, green and blue light may be emitted using various organic substances. Further the brightness of the light emitted by an organic LED depends on the voltage that is applied to it. Accordingly, an image may be displayed by organic LED devices without the use of a back light unit or color filters.

As mentioned above, organic substances capable of displaying red, green and blue light have voltage dependent display characteristics. The recombination efficiency and the brightness of different organic LEDs is different for any given voltage applied thereto.

FIG. 1 illustrates a block diagram of a related art data driver IC of a driving circuit used in an active matrix organic LED.

Referring to FIG. 1, the driving circuit of the active matrix organic LED device includes a gamma voltage generation unit 1 for generating gamma reference voltages (GMA1~GMA10) that are necessary for controlling brightnesses of organic LEDs capable of emitting red, blue, and green light; and a driving unit 2 for displaying an image upon receipt of a power voltage (VDD), a common ground voltage (GND) from a power supply unit (not shown), and the gamma reference voltages (GMA1~GMA10). The driving unit 2 also applies a current to the organic LED according to the corresponding gamma reference voltages (GMA1~GMA10) as determined by the data signal to the organic LED.

In the driving circuit of FIG. 1, identical gamma reference voltages are generated by the gamma reference voltage generation unit 1. Accordingly, the identical gamma reference voltages applied to respective organic LEDs to display red, green and blue colors.

The organic substances emitting the red, green and blue colors, however, do not have identical voltage dependent brightness characteristics. Therefore, applied voltage values corresponding to maximum brightness emissions by red, green, and blue LEDs are different.

Accordingly, when the common gamma reference voltages (GMA1~GMA10) generated by the gamma reference voltage generation unit 1 of FIG. 1 are applied, optimized brightness characteristics for each of the red, green, and blue organic LEDs in the active matrix organic LED device cannot be obtained.

FIG. 2 illustrates a detailed view of the driving unit shown in FIG. 1.

As shown in FIG. 2, the driving unit 2 includes an address shift register 10 for starting a driving operation by receiving a control signal, e.g., a clock signal (CLK), from a control unit (not shown); an input register 20 for receiving and storing the control signal from the address shift register 10 in addition to image data, e.g., RGB data from the control unit; a storage register 30 for storing, ordering according to respective addresses, and outputting the image data and control signal; a digital/analog converter 40 for receiving the ordered image data and control signal from the storage register 30, outputting analog image data, receiving the common power voltage (VDD) from the power supply unit and the plurality of gamma reference voltages (GMA1~GMA10) from the gamma voltage generation unit 1; and an output voltage driving unit 50 for receiving the analog image data and outputting the driving voltage.

Hereinafter, an operation of the driving unit 2 illustrated in FIGS. 1 and 2 will be described in detail.

When the control signal is inputted from the control unit to the address shift register 10, an enable signal corresponding to an address and comprising m number of bits is outputted on the basis of the control signal.

When given the m-bit enable signal, the input register 20 also receives i-bit image data comprising digital signals of RGB data from the control unit.

The input register 20 includes a storage means for displaying one frame of an image and has i×m×3 bits of storage space to store the RGB data, m-bit enable signal, and i-bit image data.

When a next clock signal CLK is inputted to the input register 20, the stored data are initialized and moved to the storage register 30 and data for the next frame is stored therein. The storage register 30 has an identical size as the input register 20.

Next, the storage register 30 outputs i-bit image data, corresponding to the respective addresses.

The i-bit image data of the storage register 30 is outputted and converted into an analog video signal using an digital/analog conversion unit 40. The digital/analog conversion unit 40 receives the common power voltage (VDD) regardless of the RGB data and common gamma reference voltages (GMA1~GMA10).

The voltage value of the analog image signal, determined by the gamma reference voltages and power voltages, is the same regardless of the red, green and blue devices receiving the analog image signal. Accordingly, the organic LED devices, capable of emitting red, green, and blue light, present within the active matrix organic LED device cannot be driven to emit light having a preferred brightness.

The output voltage driving unit 50 applies the analog image signal to data lines of the respective pixels through common buffering techniques.

Using the driving circuit illustrated in FIGS. 1 and 2 to drive the active matrix organic LED, identical power and gamma reference voltages are applied to all of the organic LEDs, regardless of the colors they emit. Therefore, optimal brightness characteristics of the active matrix organic LED may not be realized.

SUMMARY OF THE INVENTION

Accordingly, the present invention is directed to a driving circuit for an active matrix organic light emitting diode that substantially obviates one or more of problems due to limitations and disadvantages of the related art.

An advantage of the present invention is to provide a driving circuit for an active matrix organic LED, capable of applying different voltages that are appropriate for the brightness of the color of light to be emitted.

Additional features and advantages of the invention will be set forth in the description that follows, and in part will be apparent from the description, or may be learned by practice of the invention. Other advantages of the invention will be realized and attained by the structure particularly pointed out in the written description and claims hereof as well as the appended drawings.

To achieve these and other advantages and in accordance with the purpose of the present invention, as embodied and broadly described, a driving circuit for an active matrix organic light emitting diode (LED) includes a gamma voltage generation unit for generating gamma reference voltages having specific values that correspond to organic LEDs capable of emitting different colors; and a driving unit for outputting a video data signal of a frame by receiving the gamma reference voltages having specific values and power voltages having specific values that correspond to organic LEDs capable of emitting different colors.

Additionally, a driving unit includes an address shift register for starting a driving operation by receiving the above control signal and outputting an enable signal; an input register for receiving, storing, and outputting the enable signal from the address shift register and the image data from a control unit; a storage register for receiving, storing, and outputting the image data and enable signal inputted by the input register; a digital/analog converter for outputting analog image data according to respective addresses by receiving image data from the storage register, the power voltage and common ground voltage from the power supply unit and the gamma reference voltages from the gamma voltage generation unit; and an output voltage driving unit for receiving the analog image data and outputting the data through data lines of pixels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included herewith to provide a further understanding of the invention and are incorporated in and constitute a part of this specification, illustrate embodiments of the invention and together with the description serve to explain the principle of the invention.

In the drawings.

DETAILED DESCRIPTION OF THE ILLUSTRATED EMBODIMENTS

Reference will now be made in detail to the embodiments of the present invention, examples of which are illustrated in the accompanying drawings.

Figure 1:
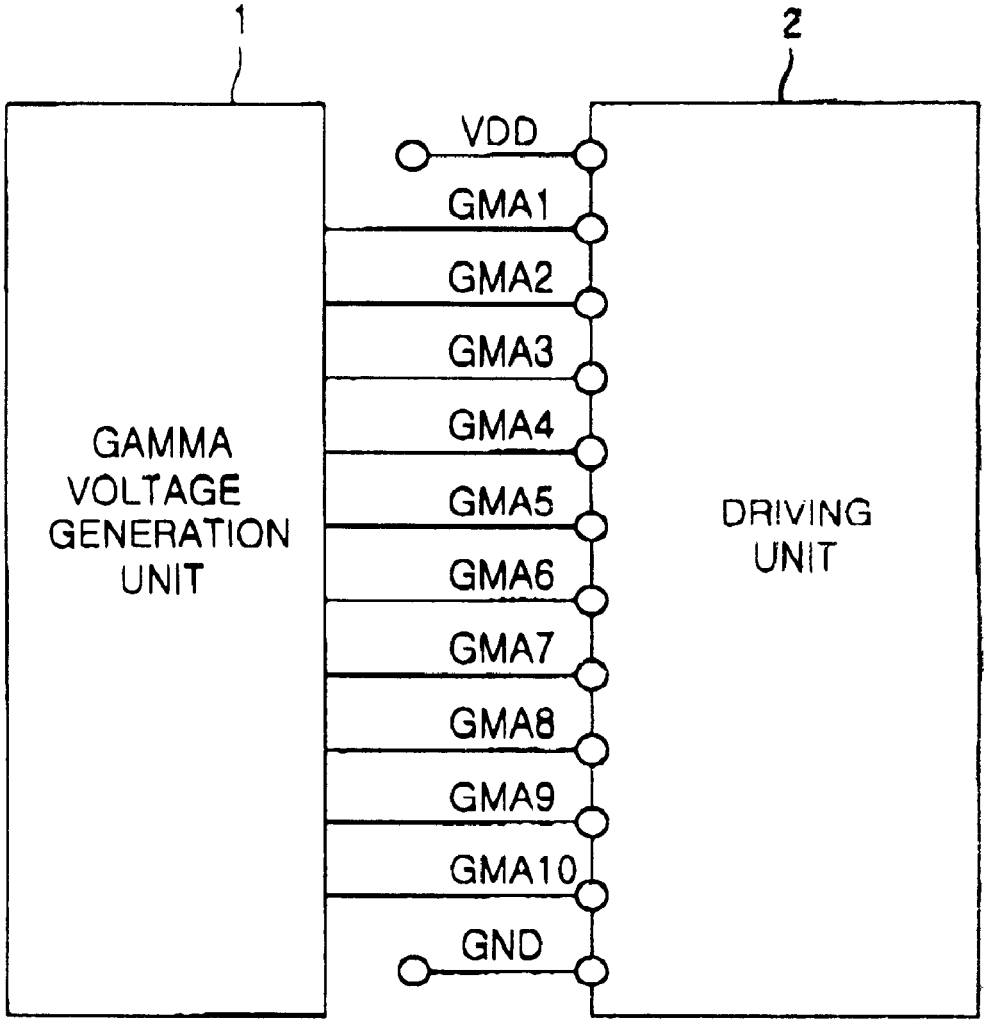
FIG. 1 RELATED ART
FIG. 1 illustrates a block diagram of a driving circuit for a related art active matrix organic light emitting diode.
Figure 2:
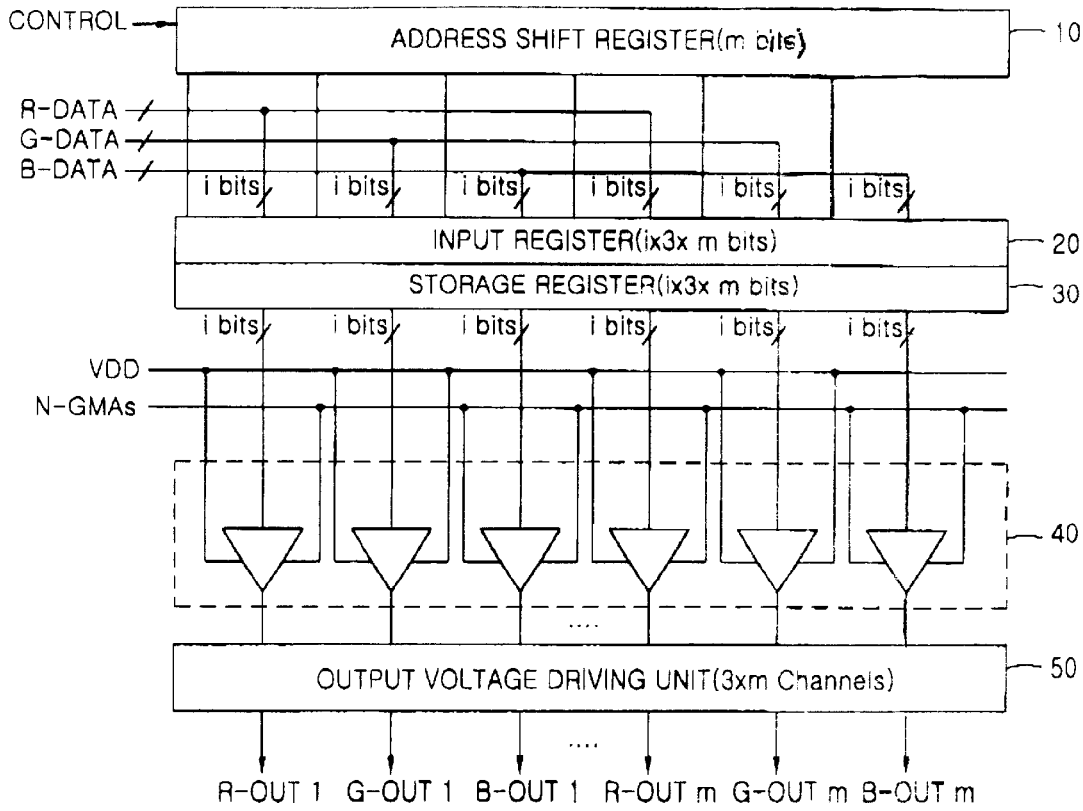
FIG. 2 RELATED ART
FIG. 2 illustrates a detailed view of the driving unit shown in FIG. 1.
Figure 3:
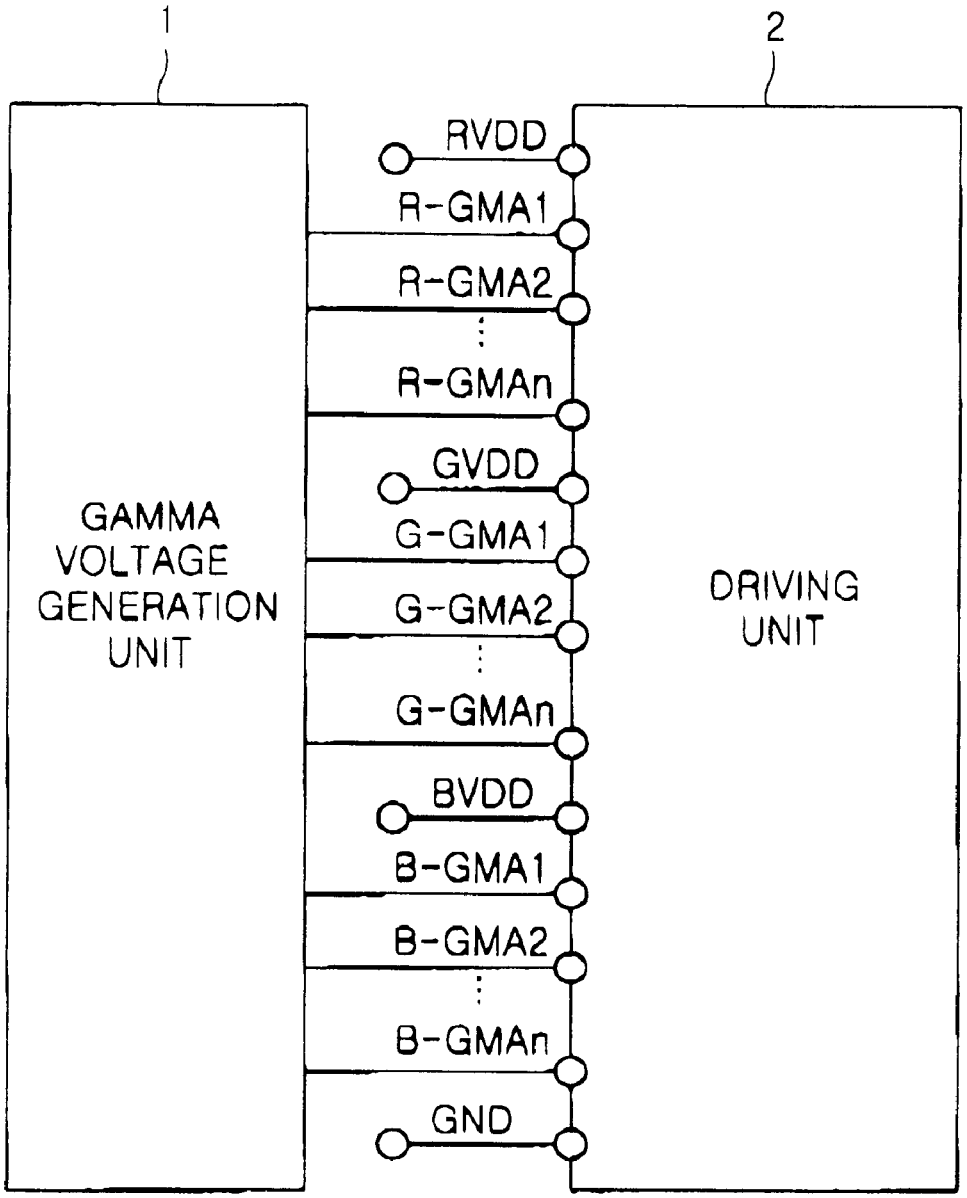
FIG. 3 illustrates a block diagram of a driving circuit for an active matrix organic LED in accordance with the principles of the present invention.

FIG. 3 illustrates a block diagram of the data driver IC of a driving circuit for an active matrix organic LED in accordance with the principles of the present invention.

Referring to FIG. 3, the driving circuit for the active matrix organic LED includes a gamma voltage generation unit 1 for generating gamma reference voltages R(GMA1~GMAn), G(GMA1~GMAn), and B(GMA1~GMAn) having values necessary for independently controlling brightnesses of LEDs capable of emitting red, green, and blue light, respectively; and a driving unit 2 for displaying an image by receiving, the gamma reference voltages R(GMA1~GMAn), G(GMA1~GMAn), and B(GMA1~GMAn), and the power voltages RVDD, GVDD, and BVDD and the common ground voltage (GND) from a power supply unit (not shown), wherein RVDD, GVDD, BVDD, correspond to power voltage values to be applied to organic LEDs capable of emitting red, green, and blue light, respectively. Further, the driving unit 2 converts a digital video data signal into an analog data signal using the above voltages and displays an image by applying the analog data signal to pixels capable of displaying the respective red, green, and blue light.

Figure 4:
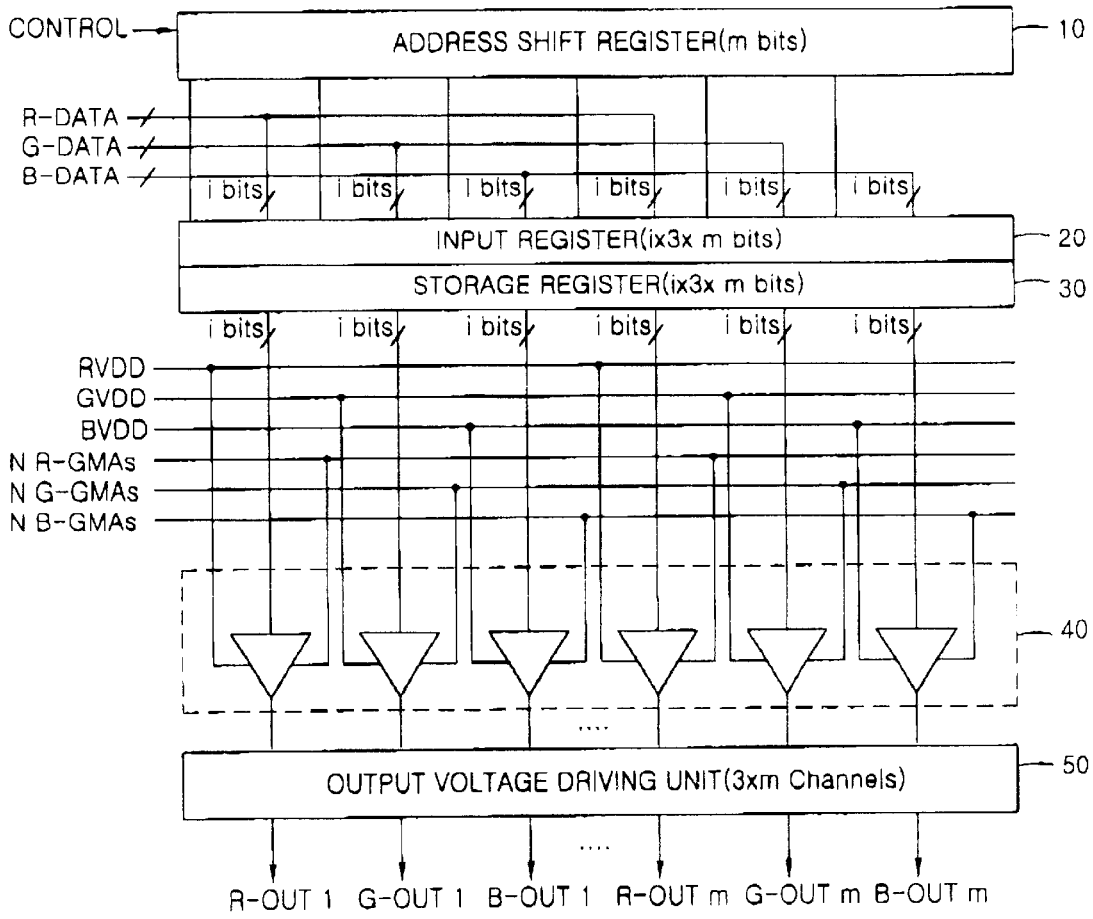
FIG. 4 illustrates a more detailed view of the driving unit shown in FIG. 3.

FIG. 4 illustrates a detailed view of the driving unit 2 shown in FIG. 3.

Generally referring to FIG. 4, the address shift register 10 starts the driving operation upon receipt of the control signal, e.g., a clock signal (CLK), from the control unit (not shown). Subsequently, register lines within an input register 20 receives and stores the control signal and image data, e.g., RGB data, from the control unit, and sequentially moves the image data, according to the clock signal, to a storage register 30. The storage register 30 sequentially stores the image data. By repeating the above processes of receiving, moving, and storing image data for output to parallel lines to completion, the image data is moved through the digital/analog conversion unit 40. Accordingly, the digital/analog conversion unit 40 receives the plurality of gamma reference voltage applied by the gamma voltage generation unit and outputs a gray scale voltage to the output voltage driving unit 50. Within the output voltage driving unit 50, the image data may be amplified before it is outputted to the data lines within the active matrix organic LED device.

To perform the aforementioned driving operation, the driving unit 2 may include an address shift register 10 for starting the driving operation by receiving the control signal, e.g., a clock signal (CLK), from a control unit (not shown);

an input register 20 for receiving and storing the control signal from the address shift register 10 in addition to image data, e.g., RGB data, from the control unit; a storage register 30 for sequentially storing, ordering according to respective addresses, and outputting the image data and control signal; a digital/analog converter 40 for receiving the ordered image data and control signal from the storage register 30, the power voltages RVDD, GVDD, and BVDD from the power supply unit, and the plurality of gamma reference voltages R(GMA1~GMAn), G(GMA1~GMAn), and B(GMA1~GMAn), and outputting analog image data; and an output voltage driving unit 50 for receiving the analog image data and outputting the driving voltage.

Hereinafter, the operation of the driving circuit 2 illustrated in FIGS. 3 and 4 will be described in more detail.

When the control signal is inputted from the control unit to the address shift register 10, the address shift register 10 outputs an enable signal corresponding to an address and comprising m number of bits.

When given the m-bit enable signal, the input register 20 also receives an i-bit data comprising digital signals of RGB data.

The input register 20 includes a storage means for displaying one frame of an image and has i×m×3 bits of storage space to store the RGB data, m-bit enable signal, and i-bit image data.

When a next clock signal CLK is inputted to the input register 20, the stored data are initialized and moved to the storage register 30 and data for the next frame is stored therein. The storage register 30 has an identical size as the input register 20.

Next, the storage register 30 outputs i-bit image data, corresponding to the respective addresses.

The i-bit image data of the storage register 30 is outputted and converted into an analog video signal using a digital/analog conversion unit 40. The digital/analog conversion unit 40 receives the power voltages RVDD, GVDD, and BVDD and the gamma reference voltages R(GMA1~GMAn), G(GMA1~GMAn), and B(GMA1~GMAn).

The voltage value for each of the analog image signals, determined by the specific gamma reference and power voltages, is unique for each of the organic LEDs capable of emitting red, green and blue light. Accordingly, the preferred brightness of each pixel within the active matrix organic LED device may be fully realized.

The output voltage driving unit 50 applies the analog image signal to data lines of the respective pixels through common buffering techniques.

The analog image signal outputted by the output driving voltage unit 50 (not shown) is inputted to the data lines of the pixels in the active matrix organic LED device according to a gate driving signal to thereby display color with a maximum brightness.

Organic LEDs employ different voltage driving methods to display images compared to driving methods used by conventional LCDs. According to principles of the present invention, exact control of LEDs emitting different colors of light may be achieved by generating unique gamma reference voltages whose values are dependent on the color of light emitted by the LEDs.

Figure 5:
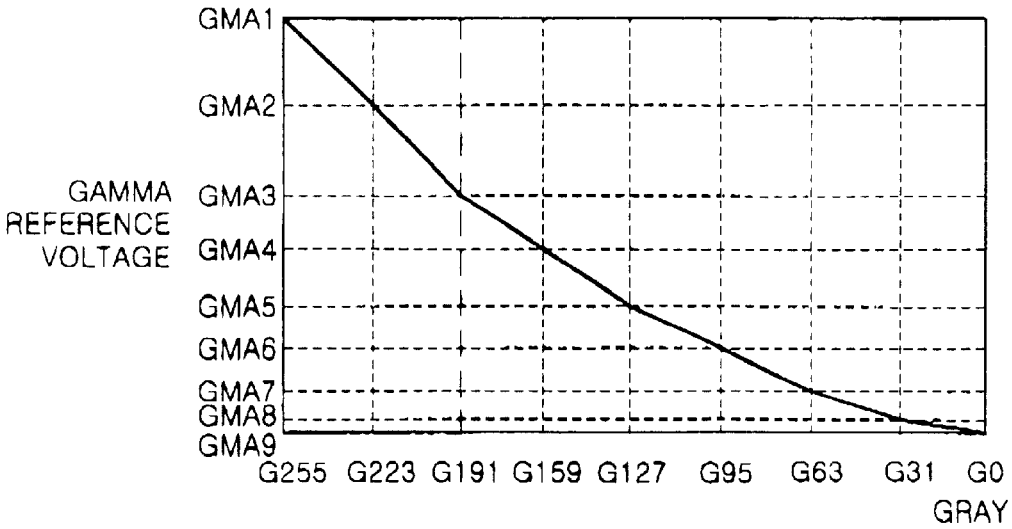
FIG. 5 is graph illustrating the relationship of gray scale brightness and gamma reference voltages.

FIG. 5 is a graph illustrating the relationship of gray scale and gamma reference voltage.

As illustrated in FIG. 5, the gray scale interval of each gamma reference voltage is decreased as the gray scale is lowered.

Various organic LEDs capable of emitting red, green, and blue light are differently affected by any single gamma reference voltage. According to the principles of the present invention, digital signals converted by the digital/analog conversion unit 40 may be converted into analog signals using the unique gamma reference voltages. Accordingly, the output driving voltage unit 50 may efficiently and truly display information contained within the video signal.

Figure 6:
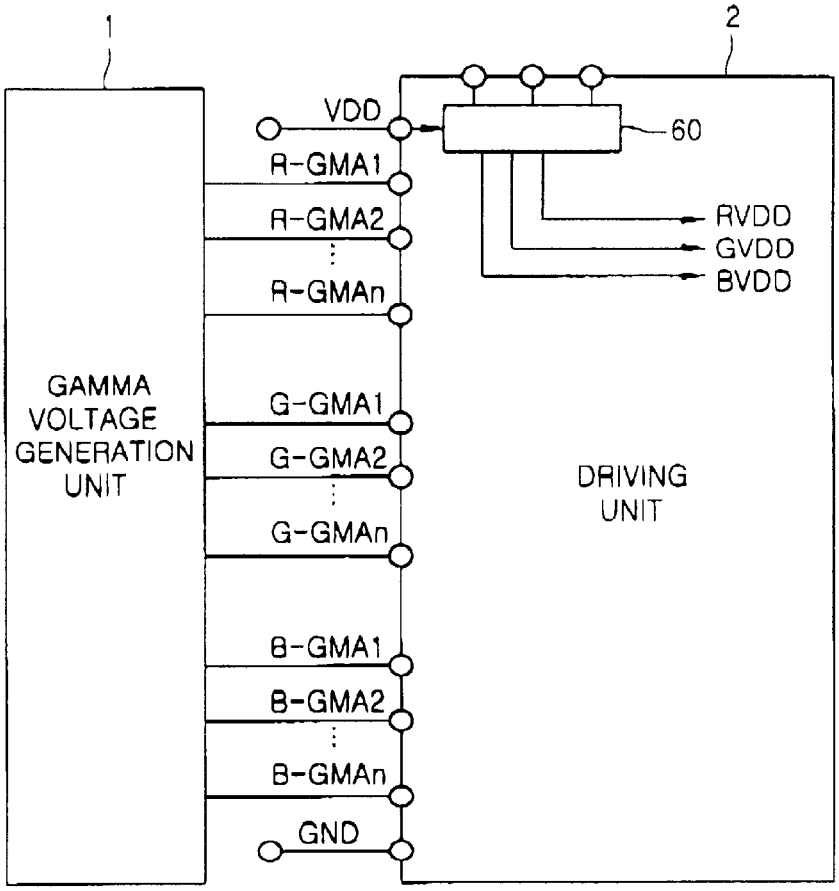
FIGS. 6 to 8 illustrate views of other embodiments according to the principles of the present invention.

FIG. 6 illustrates a block diagram according another embodiment of the present invention.

Referring to FIG. 6, the gamma voltage generation unit 1 generates gamma reference voltages necessary for independently controlling red, green, and blue brightnesses of light emitted by various organic LEDs. Power and common ground voltages may be directly inputted from the outside. Additionally, power voltages applied to different organic LEDs emitting different colors of light may not be identical and may be generated by a voltage generation unit 60 included within the driving unit 2.

Figure 7:
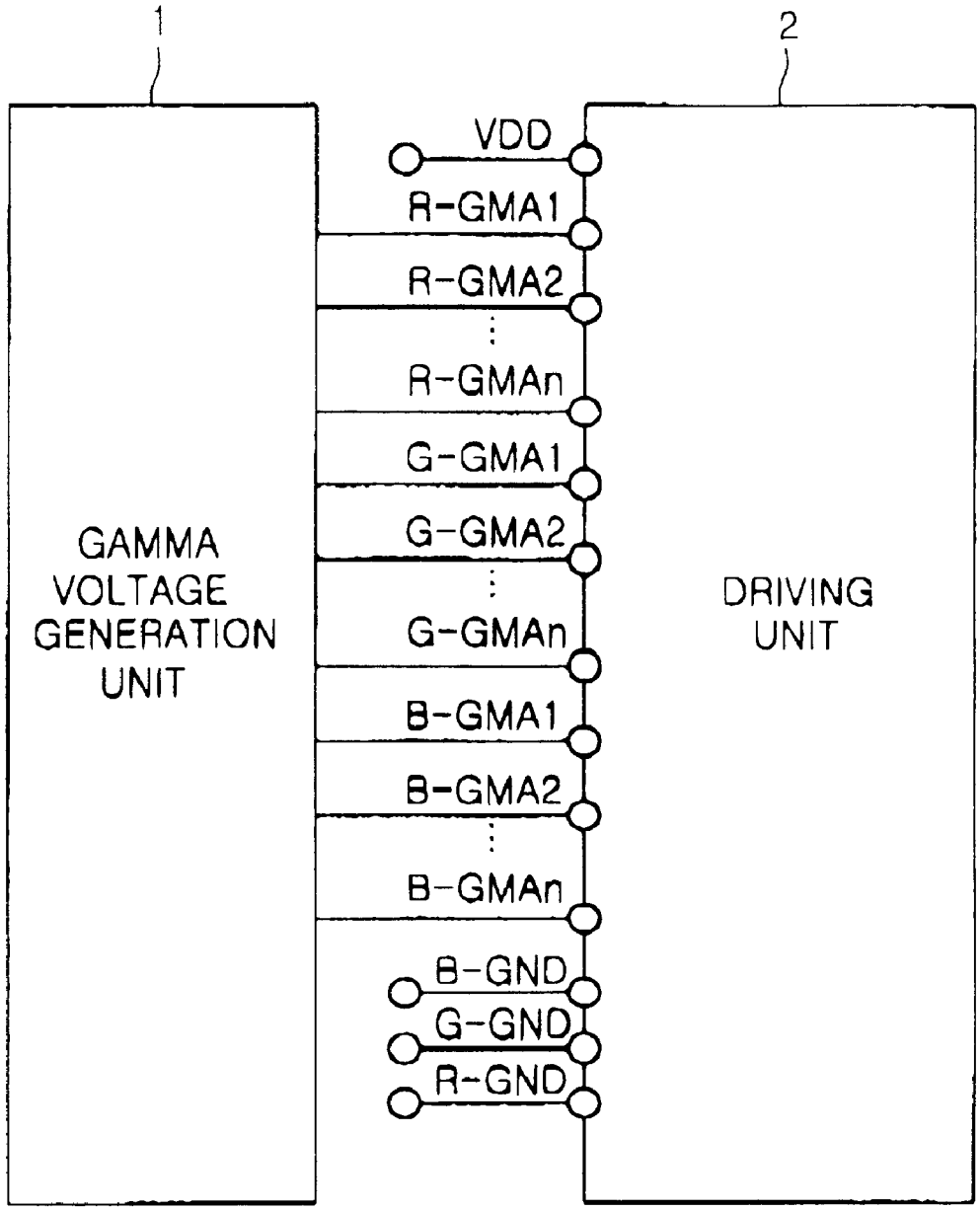

FIG. 7 illustrates a block diagram according to still another embodiment of the present invention.

Referring to FIG. 7, voltages appropriate for independently controlling a pixel according to the colors of light they emit may be applied by applying different externally provided common ground voltages, e.g., R-GND, G-GND and B-GND, to different organic LEDs emitting different colors. Further, in the present embodiment, the power voltages VDD may be fixed.

Figure 8:
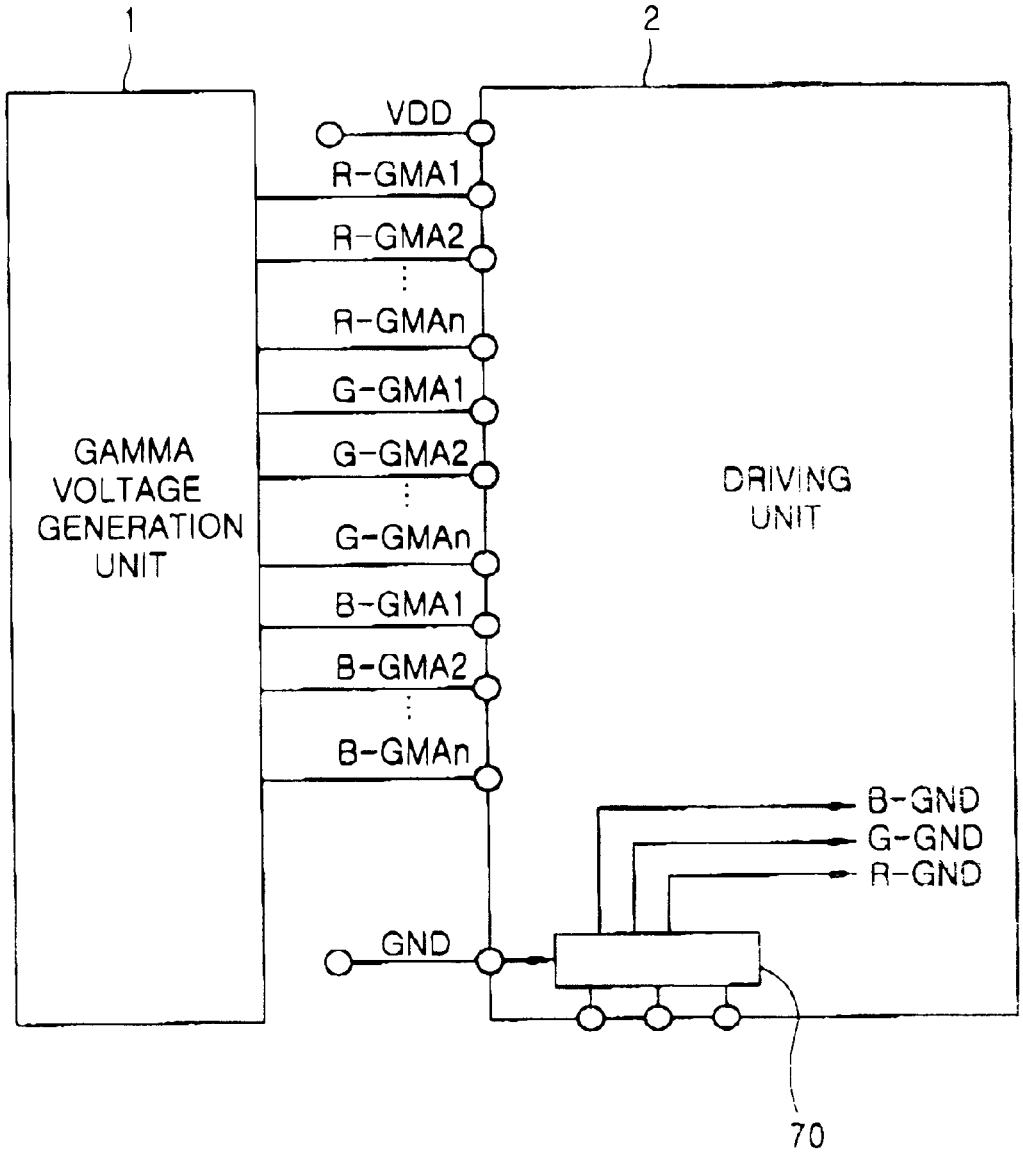

FIG. 8 illustrates a block diagram according to still another embodiment of the invention shown in FIG. 7.

Referring to FIG. 8, a voltage generation unit 70, included within the driving unit 2, may receive a single common ground voltage GND and differentiate the single voltage into a plurality of unique common ground voltages, e.g., R-GND, G-GND, and B-GND. These differentiated unique common ground voltages may then be applied to the different organic LEDs. In one aspect of the present embodiment, since a single common ground voltage is differentiated within the driving unit, the number of exterior terminals may be reduced.

According to the principles of the present invention, a driving circuit for an active matrix organic LED device generates a video signal that is applied to pixels. The video signal displays red, green, and blue colors using power and gamma reference voltages dependent on the color of light an LED emits. Accordingly each pixel within an active matrix organic LED device may be driven to display brightness values exactly as described by video signals, thereby the quality of the image may be improved.

It will be apparent to those skilled in the art that various modifications and variation can be made in the method of manufacturing a flat panel display device of the present invention without departing from the spirit or scope of the invention. Thus, it is intended that the present invention cover the modifications and variations of this invention provided they come within the scope of the appended claims and their equivalents.

What is claimed is:

1. A driving circuit for an active matrix organic light emitting diode, comprising:

a gamma voltage generation unit for generating differentiated gamma reference voltages having values corresponding to light emitting diodes capable of emitting red, green, and blue colors;

a power supply unit for applying power voltage and a common ground voltage;

a control unit for outputting a control signal and image data; and a driving unit for outputting a video data signal of a frame by receiving the differentiated gamma reference voltages from the gamma voltage generation unit, the power voltage and common ground voltage from the power supply unit and the control signal and image data from the control unit.

2. The circuit of claim 1, wherein the driving unit includes:

an address shift register for starting a driving operation upon receiving the control signal and outputting an enable signal;

an input register for receiving, storing, and outputting the enable signal from the address shift register and the image data from the control unit;

a storage register for receiving, storing, and outputting the image data and enable signal inputted by the input register;

a digital/analog converter for outputting analog image data according to respective addresses by receiving image data from the storage register, the power voltage and common ground voltage from the power supply unit and the gamma reference voltages from the gamma voltage generation unit; and an output voltage driving unit for receiving the analog image data and outputting the data through data lines of pixels.

3. The circuit of claim 1, wherein the driving unit receives three power voltages corresponding to light emitting diodes capable of emitting red, green, and blue colors and a common ground voltage from the power supply unit.

4. The circuit of claim 1, wherein the driving unit further includes a power voltage generation unit for receiving a power voltage from the power supply unit and converting the power voltage into different voltages corresponding to light emitting diodes capable of emitting red, green, and blue colors.

5. The circuit of claim 1, wherein the driving unit receives a power voltage and three common ground voltages corresponding to light emitting diodes capable of emitting red, green, and blue colors from the power supply unit.

6. The circuit of claim 1, wherein the driving unit further includes a common ground voltage generation unit for receiving a common ground voltage from the power supply unit and converting the common ground voltage into different voltages corresponding to light emitting diodes capable of emitting red, green, and blue colors.

7. A driving circuit for an active matrix organic LED display including a plurality of data lines, the active matrix organic LED display capable of emitting light comprised of a plurality of colors, the driving circuit comprising:

a first voltage generation unit for providing a first voltage type capable of influencing a brightness of light emitted by organic LEDs;

a driving unit coupled to the first voltage generation unit for providing a video data signal driving voltage to the plurality of data lines; and a second voltage generation unit for supplying a second voltage type to the driving unit, wherein the driving unit provides the video data signal upon receipt of the first and second voltages, wherein at least one of the first and second voltage types comprise a plurality of differentiated voltage values, each of the plurality of differentiated voltage values corresponding to each of the plurality of colors.

8. The circuit of claim 7, wherein the first voltage generation unit comprises a gamma voltage generation unit and the first voltage type comprises a plurality of gamma reference voltages.

9. The circuit of claim 7, wherein the first voltage type comprises the plurality of differentiated voltage values.

10. The circuit of claim 7, wherein the second voltage type comprises a power voltage and a common ground voltage.

11. The circuit of claim 10, wherein the power voltage comprises the plurality of differentiated voltage values.

12. The circuit of claim 10, wherein the common ground voltage comprises the plurality of differentiated voltage values.

13. The circuit of claim 7, further comprising a voltage generation unit wherein the driving unit plurality of differentiated voltage values are generated within the driving unit.

14. The circuit of claim 7, wherein the second voltage generation unit comprises a power supply unit located externally outside the driving unit.

15. The circuit of claim 7, wherein the second voltage generation unit comprises a voltage generation unit located internally within the driving unit.

16. A method for driving an active matrix organic LED display including a plurality of data lines, the active matrix organic LED display capable of emitting light comprised of a plurality of colors, the method comprising:

providing, to a driving unit, a first voltage type capable of influencing a brightness of light emitted by organic LEDs; and providing, to the driving unit, a second voltage type, wherein the driving unit provides a video data signal upon receipt of the first and second voltages, wherein at least one of the first and second voltage types comprise a plurality of differentiated voltage values, each of the plurality of differentiated voltage values corresponding to each of the plurality of colors.

17. The method of claim 16, wherein the first voltage type comprises a plurality of gamma reference voltages and the second voltage type comprises a power voltage and a common ground voltage.

18. The method of claim 16, wherein first voltage type comprises the plurality of differentiated voltage values.

19. The method of claim 17, wherein the power voltage comprises the plurality of differentiated voltage values.

20. The method of claim 17, wherein the common ground voltage comprises the plurality of differentiated voltage values.

* * * * *